United States Patent [19]

Berrill et al.

[11] 4,377,876

[45] Mar. 29, 1983

[54] SHOE LASTING MACHINE

[75] Inventors: William H. Berrill, Leicester; Herbert W. Boot, Thurmaston, both of England

[73] Assignee: USM Corporation, Farmington, Conn.

[21] Appl. No.: 243,473

[22] Filed: Mar. 13, 1981

[30] Foreign Application Priority Data

Mar. 22, 1980 [GB] United Kingdom ..... 8009772

[51] Int. Cl.[3] ..... A43D 21/00

[52] U.S. Cl. ..... 12/8.3; 118/315

[58] Field of Search ..... 12/7, 8.3, 12, 142 R; 118/315, 205, 256, 263, 300

[56] References Cited

U.S. PATENT DOCUMENTS 3,234,574 2/1966 Becker et al. ..... 12/12

3,445,872 5/1969 Pisaroni ..... 12/8.3

3,849,818 11/1974 Brailsford et al. ..... 12/8.3

*Primary Examiner*—Patrick D. Lawson

*Attorney, Agent, or Firm*—Donald N. Halgren

[57] ABSTRACT

Provision is made for enabling the adhesive applying nozzles on a shoe lasting machine to be initially positioned offset from the longitudinal center line of the machine, selectively at one side or the other according to whether the shoe to be lasted is a left or a right. To this end each nozzle is movable, independently of the other, widthwise of the shoe bottom and has stop means associated therewith. At the start of a machine cycle, one stop means is in an operative position, in which its associated nozzle is in a desired offset position, while the other stop means is in a retracted position, allowing its associated nozzle to move to a position adjacent the first-mentioned nozzle. After engagement with the shoe bottom said one stop means is also retracted, so that both nozzles are then free to follow the edge contour of the shoe bottom without constraint.

13 Claims, 2 Drawing Figures

SHOE LASTING MACHINE

BACKGROUND OF THE INVENTION (1) Field of the Invention

This invention is concerned with machines for lasting side portions of shoes.

(2) Prior Art

One machine for lasting side portions of shoes comprises a shoe support arrangement, by which a last carrying a shoe upper and an insole can be supported, adhesive applying means, means for effecting relative movement, in a direction extending heightwise of a shoe supported by the shoe support arrangement, between the shoe support arrangement and the adhesive applying means, between an operative condition of the adhesive applying means, in which said means contacts the insole of a shoe supported by the shoe support arrangement, and a retracted condition of said means. The machine also comprising means for effecting relative movement in a direction extending lengthwise of a shoe supported by the shoe support arrangement, between the shoe support arrangement and the adhesive applying means, the adhesive applying means comprising two nozzles arranged, when in operative condition, to operate along opposite sides of a shoe supported by the shoe support arrangement and being movable in a direction extending widthwise of such shoe, thus to apply adhesive progressively between lasting marginal portions of the upper and corresponding marginal portions of the insole of such shoe, while following the edge contour thereof, as relative lengthwise movement is effected as aforesaid. The machine further comprising side lasting instrumentalities by which the lasting marginal portions of such shoe can be wiped over the corresponding marginal portions of the insole and pressed thereagainst, thus to secure said portions together by the adhesive applied therebetween.

There is described in U.S. Pat. No. 3,963,840 a machine of the type referred to above, in which the nozzles are supported, for pivotal movement, the arrangement being such that, when the nozzles are to be moved to their operative condition, they are first centralized on the block by engagement with stop means, one for each nozzle, mounted on the block, while the block itself is caused to pivot, by the actuation of a selected one of two piston-and-cylinder arrangements arranged to operate on the block at opposite sides of the pivot thereof, thus to bring the nozzles into an offset position, i.e. to one side or other of the longitudinal center line of the machine. The particular piston-and-cylinder arrangement selected to be so actuated is determined according to whether the shoe to be operated upon is a left or a right. With the nozzles in such offset position, they are moved into operative condition, whereafter the actuated piston-and-cylinder arrangement becomes deactuated, thus leaving the block free to pivot without constraint thereby enabling the nozzles supported thereby to be moved in a direction extending widthwise of the shoe bottom. At the same time, the nozzles are urged outwardly from one another so that, as lengthwise relative movement is effected between the shoe support arrangement and the adhesive applying means, the nozzles are caused to follow the edge contour of the shoe bottom. In so following the edge contour, it may be that one or other nozzle is brought into engagement with its associated stop means; in such a case, the nozzle will then be effective through its associated stop means, to cause the block to pivot bodily. It will thus be appreciated that the arrangement for enabling the nozzles to follow the edge contour, while at the same time allowing the nozzles to be initially moved into an operative condition, in a desired offset position, is relatively complicated, and furthermore requires separate motor means for controlling the position of the block and for controlling the initial position of the nozzles in relation to the block, the second such motor means also serving to control the widthwise movement of the nozzles as they follow the edge contour of the shoe bottom as aforesaid.

It is the object of the present invention to provide an improved machine for lasting side portions of shoe uppers in the operation of which the arrangement referred to hereinbefore is significantly simplified while achieving the same ends.

BRIEF SUMMARY OF THE INVENTION

The invention thus provides a machine for lasting side portions of shoes, comprising a shoe support arrangement, by which a last carrying a shoe upper and an insole can be supported, adhesive applying means, means for effecting relative movement, in a direction extending heightwise of a shoe supported by the shoe support arrangement, between the shoe support arrangement and the adhesive applying means, between an operative condition of the adhesive applying means, in which said means contacts the insole of a shoe supported by the shoe support arrangement, and a retracted condition of said means, and means for effecting relative movement, in a direction extending lengthwise of a shoe supported by the shoe support arrangement, between the shoe support arrangement and the adhesive applying means, the adhesive applying means comprising two nozzles arranged, when in operative condition, to operate along opposite sides of a shoe supported by the shoe support arrangement and being movable in a direction extending widthwise of such shoe, thus to apply adhesive progressively between lasting marginal portions of the upper and corresponding marginal portions of the insole of such shoe, while following the edge contour thereof, as relative lengthwise movement is effected as aforesaid. The machine further comprising side lasting instrumentalities by which the lasting marginal portions of such shoe can be wiped over the corresponding marginal portions of the insole and pressed thereagainst, thus to secure said portions together by the adhesive applied therebetween, wherein means is provided for moving each nozzle, independently of the other, in a direction extending widthwise of such shoe as aforesaid, and thus for urging each nozzle to follow the edge contour of such shoe, and wherein one of the nozzles has stop means associated therewith by which, when in an operative position, the position of said nozzle, widthwise of the shoe, can be determined, the arrangement being such that, at the start of a cycle of operation of the machine, with the nozzles in retracted condition, and with the stop means in its operative position, said one nozzle is positioned by said stop means and the other nozzle is positioned adjacent said one nozzle, and thereafter, with the nozzles in operative condition, said stop means is moved to a retracted position, thus to allow the nozzles to follow the edge contour of such shoe, as relative lengthwise movement is effected between the shoe support arrangement and the adhesive applying means.

It will thus be appreciated that by each nozzle being thus controlled independently of the other for movement widthwise of the shoe bottom, a simpler less expensive arrangement can thus be achieved.

Customarily, machines of the type in question are capable of operating upon left and right shoes, and often are arranged to operate upon left and right shoes alternately. To this end, each nozzle preferably has stop means associated therewith, the arrangement being such that, at the start of a cycle of operation of the machine, the stop means associated with one of the nozzles, selected according to whether the shoe to be operated upon is a left or a right, is in its operative position and the stop means associated with the other nozzle is in its retracted position.

In order further to simplify the construction, furthermore, preferably the movement of each nozzle in a direction extending widthwise of the shoe as aforesaid is limited by the means for effecting such movement, the arrangement being such that the position of said other nozzle adjacent said one nozzle, at the start of an operating cycle, represents one limit position of the widthwise movement of said other nozzle. Conveniently, the means for effecting widthwise movement of the nozzles comprises, for each nozzle, a fluid prressure operated piston-and-cylinder arrangement.

The order of each stop means of the machine in accordance with the invention conveniently comprises a stop member which, in its operative position, can be engaged by an abutment associated with the nozzle with which said stop means is associated. Furthermore, such stop member is conveniently carried by a lever which can be locked in a position corresponding to the operative position of the stop member. Furthermore, the abutment may conveniently be carried by a piston rod of the piston-and-cylinder arrangement by which the widthwise movement of the nozzle associated with the stop member is effected, so that engagement of the abutment with the stop member is directly effective to limit the movement of the nozzle associated therewith. In addition, the lever which carries the stop member may conveniently be locked in a position as aforesaid by means of a toggle arrangement which may be operated e.g. by fluid pressure operated means. In this way, the stop means can be quickly and reliably moved between operative and retracted positions.

In order to move the nozzles between the operative and the retracted condition, the adhesive applying means preferably comprises two carriers, one supporting each nozzle, the carriers being mounted for pivotal movement, independently of one another, about an axis extending widthwise of a shoe support about a shoe support arrangement. In the machine in accordance with the invention, furthermore, in order to enable the nozzles to effect movement widthwise of such shoe bottom, thus to follow the edge contour of the shoe, each carrier conveniently supports a support arm on which its associated nozzle is supported, each arm being mounted for pivotal movement, independently of the other, about an axis extending heightwise of such shoe bottom. In this way, the two pivotal movements required for each nozzle as aforsaid are separated, thereby again facilitating the simplification of construction in the machine in accordance with the invention.

Furthermore, each lever carrying a stop member is mounted for pivotal movement about the axis about which its associated support arm is mounted for movement as aforesaid, while conveniently the toggle arrangement and the means for operating it are carried on the carrier carrying the support arm by which the nozzle associated with said arrangement is supported. Conveniently also each piston-and-cylinder arrangement for effecting widthwise movement of the nozzles is carried on the carrier carrying the support arm by which the nozzle associated with said arrangement is supported.

BRIEF DESCRIPTION OF THE DRAWINGS

There now follows a detailed description, to be read with reference to the accompanying drawings, of one machine constructed in accordance with the invention, this machine having been selected for description merely by way of exemplification of the invention and not by way of limitation thereof.

In the accompanying drawings.

DESCRIPTION OF THE PREFERRED EMBODIMENTS

Figure 1:
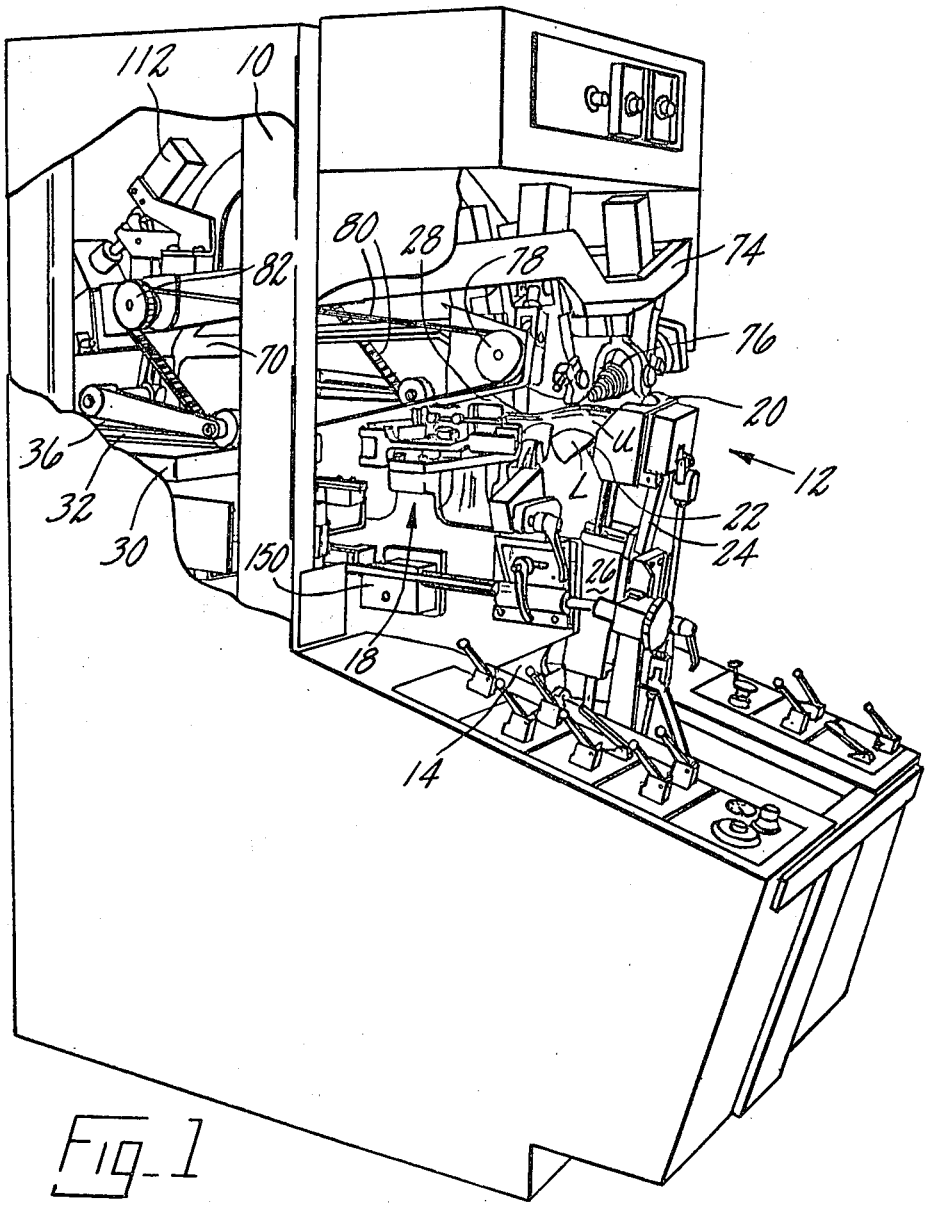
FIG. 1 is a perspective view of the machine, viewed from the left hand side of the front thereof.

The machine hereinafter described is utilized for lasting side portions of shoes and is generally similar, except as hereinafter described, to the machine disclosed in U.S. Pat. No. 3,849,817. Thus, the machine comprises a main frame 10 which supports a shoe support arrangement generally designated 12 for movement fore-and-aft of the machine, i.e. in a direction extending lengthwise of the bottom of a shoe supported thereby as shown in FIG. 1. The shoe support arrangement comprises a last post 14 having an upstanding last pin (not shown) on which a last L carrying a shoe upper U and insole can be supported, bottom uppermost, means (not shown) being provided for swinging the last post 14 from a loading position into an operative position in which the heel end of the shoe supported thereby is clamped by a heel and side clamp arrangement generally designated 18. In addition, the shoe support arrangement 12 comprises a toe end engaging member 20 and a toe rest 22, said member and toe rest being carried by a support 24 which is mounted for pivotal movement to bring the engaging member 20, which is generally U-shaped to accommodate the toe end, into engagement with said toe end, the arrangement being such that the engaging member 20 serves to position the shoe in the shoe support arrangement in a desired relationship with the longitudinal center line of the machine. A piston-and-cylinder arrangement 26 is provided for moving the toe rest 22 heightwise, and a holddown member 28 is associated with the heel and side clamp arrangement 18 for determining the heightwise position of the shoe in the shoe support arrangement.

The main frame 10 includes a table portion 30 supporting, through an intermediate spacer plate 32, a phase plate 36 which carries, at its forward end, a bridge member 70 on which a support frame 74 is pivotally mounted, said frame carrying at its forward end side lasting instrumentalities in the form of lasting rolls 76. The lasting rolls are generally conical, with their apices adjacent one another, each roll being rotatable about an axis extending widthwise of the bottom of a shoe supported by the shoe support arrangement and each being provided with a wiping element disposed helically about the circumference thereof. For rotating the rolls, a drive arrangement is provided including a first pulley 78 operatively connected to its associated lasting roll, and connected by a drive belt 80 to a second pulley 82 rotatable about an axis coincident with the axis of the support shaft 72 and carrying a further, larger diameter, pulley (not shown) which is driven by means of an electric motor (not shown) mounted on the base plate 36. Furthermore, fluid causing the support frame 74 to pivot, thus to move the lasting rolls heightwise into and out of engagement with the bottom of a shoe to be operated upon.

Figure 2:
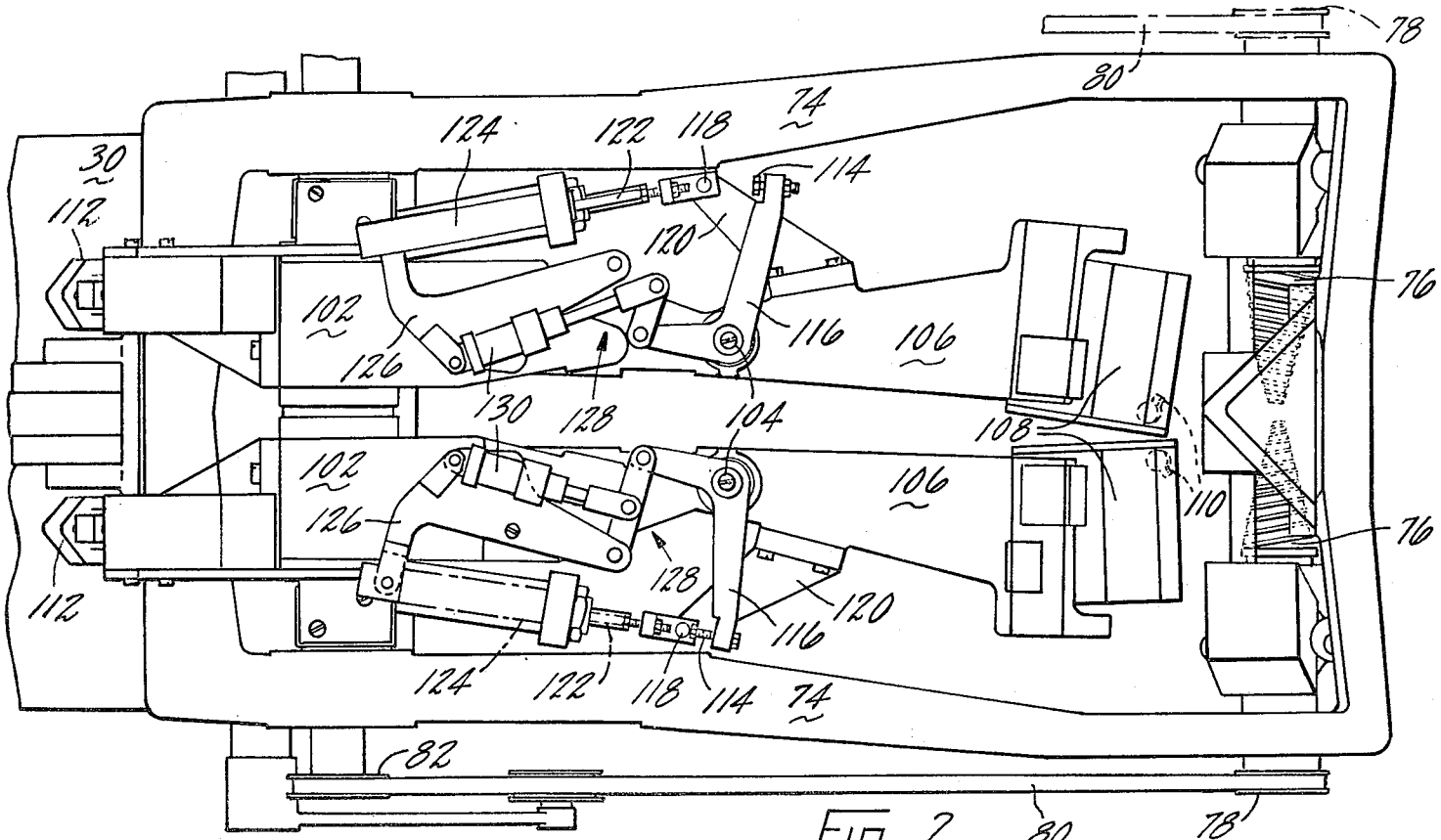
FIG. 2 is a fragmentary plan view showing details of the adhesive applying means and the supports therefor.

Mounted for movement about the same pivot as the frame 74 are two carrier members 102 at the end, remote from the pivot, on each of which a vertical pin 104 is carried. The pin 104 carries a support arm 106, each arm in turn supporting a melt chamber 108 and an adhesive applying nozzle 110 operatively connected to the melt chamber. By this arrangement, each nozzle 110 is capable, independently of the other, of pivoting heightwise, about the axis on which the support frame 74 pivots, and also widthwise, each about the axis of its pin 104, in relation to the bottom of a shoe to be operated upon. For effecting such pivotal heightwise movement, furthermore, each nozzle 110 has associated therewith a piston-and-cylinder arrangement 112 secured on the bridge member 70. For controlling the position of each nozzle, widthwise of the shoe bottom, when it is to be moved to an operative condition in contact with the insole of the shoe to be operated upon, each nozzle 110 has stop means associated therewith, in the form of a headed bolt 114 which is adjustably mounted in one end of an arm of a bell crank lever 116 itself mounted for pivotal movement about the axis of the pin 104, the headed bolt 114 being arranged to be engaged by an abutment pin 118 carried by a bracket 120 on the support arm 106 of the nozzle associated with the stop means, said pin 118 being connected to a piston rod 122 of a piston-and-cylinder arrangement 124 supported on a bracket 126 carried by the carrier member 102. The stop member 114 is movable between a retracted and on operative position by means of a toggle arrangement generally designated 128, which is connected to the other arm of the bell crank lever 116 remote from the stop member 114. The toggle arrangement, which includes a piston-and-cylinder arrangement 130, is also mounted on the bracket 126. The stop means is so constructed and arranged that when the toggle is "made", the headed bolt 114 is in its operative position (see the lower stop means in FIG. 2), while when the toggle arrangement is in a "broken" condition, the bolt 114 is moved to its retracted position (see the upper stop means in FIG. 2), in which retracted position the bolt 114 is removed out of the path of movement of the abutment pin 118 associated therewith.

The headed bolts 114 are adjustably mounted in the bell crank levers 116 so as to enable, when each bolt is in operative position, the position of its associated nozzle to be adjusted according to the shape of the shoe bottom to be operated upon, when the nozzle, in operative condition, is moved into engagement with the insole of such shoe.

It will be appreciated that, in the operation of the machine, the nozzles are capable of being offset at either side of the longitudinal center line of the machine, according to whether the shoe to be operated upon is a left or a right. The selection of the appropriate offset position is determined by actuation of one of two valves (not shown) which are arranged to be selectively actuated, one being positioned on each side of the support 24 by which the toe end engaging member 20 and two rest 22 are supported, said support being movable in a direction extending widthwise of the bottom of a shoe supported by the shoe support arrangement between two positions according to whether the shoe to be operated upon is a left or a right. Actuation of a selected one of said valves is thus effective to cause the appropriate one of the piston-and-cylinder arrangements 130 to be actuated to "make" its associated toggle arrangement 128, so that the stop member 114 associated therewith is moved to its operative position. At the same time, the other toggle arrangement 128 remains in its "broken" condition, so that its associated stop member 114 is moved to its retracted position. At the same time, both piston-and-cylinder arrangements 124 are actuated whereupon the one abutment pin 118 cooperating with the stop member 114 in its operative position is moved into engagement with said stop member, thereby positioning its associated nozzle in an offset condition, while the pin 118 associated with the other stop member 114 is not so arrested, but rather is moved to the extent of the stroke of its associated piston-and-cylinder arrangement 124, so that its associated nozzle is moved to a position closely adjacent the other nozzle. At this state in the operation of the machine, the nozzles are still in retracted condition, but having been so positioned in an offset condition, they can then be moved to operative condition, in engagement with the insole of a shoe supported by the shoe support arrangement, whereafter the nozzles are moved outwardly to a position in which they can apply adhesive between the lasting marginal portion of the upper U and corresponding marginal portions of the insole, following the edge contour of the shoe bottom, as relative lengthwise movement is effected between the nozzles and the shoe support arrangement. For moving the nozzles outwardly, fluid under pressure is admitted to the opposite side of the piston-and-cylinder arrangements 124, which arrangements are thereafter effective to control the movements widthwise of the shoe bottom, of each nozzle independently of the other. Furthermore, when the nozzles are moved as aforesaid to operative condition, the piston-and-cylinder arrangement 130 by which one of the toggles 128 has previously been "made" as aforesaid is de-actuated, whereupon its associated toggle arrangement is "broken". In this condition, both stop members 114 are moved to their retracted positions and in no way interfere with the movement of each nozzle, widthwise of the shoe bottom, during the remainder of the cycle of operation of the machine.

We claim:

1. A machine for lasting side portions of shoes, comprising:

a shoe support arrangement by which a last carrying a shoe upper and an insole can be supported, adhesive applying means, means for effecting relative movement, in a direction extending heightwise of a shoe supported by the shoe support arrangement, between the shoe support arrangement and the adhesive applying means, between an operative condition of the adhesive applying means, in which said means contacts the insole of a shoe supported by the shoe support arrangement, and a retracted condition of said means;

means for effecting relative movement, in a direction extending lengthwise of a shoe supported by the shoe support arrangement, between the shoe support arrangement and the adhesive applying means, the adhesive applying means comprising two nozzles arranged, when in operative condition, to operate along opposite sides of a shoe supported by the shoe support arrangement and being movable in a direction extending widthwise of such shoe, thus to apply adhesive progressively between lasting marginal portions of the upper and corresponding marginal portions of the insole of such shoe while following the edge contour thereof, as relative lengthwise movement is effected as aforesaid;

an arrangement of side lasting instrumentalities by which the lasting marginal portions of such shoe upper can be wiped over the corresponding marginal portions of the insole and pressed thereagainst, thus to secure said portions together by the adhesive applied therebetween, wherein means is provided for moving each nozzle, independently of the other, in a direction extending widthwise of such shoe as aforesaid, and thus for urging each nozzle to follow the edge contour of such shoe, and wherein one of the nozzles has stop means associated therewith by which, when in an operative position, the position of said nozzle, widthwise of the shoe, can be determined, the arrangement being such that, at the start of a cycle of operation of the machine, with the nozzles in retracted condition, and with the stop means in its operative position, said one nozzle is positioned by said stop means and the other nozzle is positioned adjacent said one nozzle, and thereafter, with the nozzles in operative condition, said stop means is moved to a retracted position, thus to allow the nozzles to follow the edge contour of such shoe, as relative lengthwise movement is effected between the shoe support arrangement and the adhesive applying means.

2. A machine for lasting side portions of shoes as recited in claim 1, wherein each nozzle has a stop means associated therewith, the arrangement being such that, at the start of a cycle of operation of the machine, the stop means associated with one of the nozzles, selected according to whether the shoe to be operated upon is a left or a right, is in its operative position and the stop means associated with the other nozzle is in its retracted position.

3. A machine for lasting side portions of shoes as recited in claim 2, wherein the movement of each nozzle in a direction extending widthwise of the shoe as aforesaid is limited by the means for effecting such movement, the arrangement being such that the position of said other nozzle adjacent said one nozzle, at the start of an operating cycle, represents one limit position of the widthwise movement of said other nozzle.

4. A machine for lasting side portion of shoes as recited in claim 3, wherein the means for effecting widthwise movement of the nozzles comprises, for each nozzle, a fluid pressure operated piston-and-cylinder arrangement.

5. A machine for lasting side portions of shoes as recited in claim 4, wherein each stop means comprises a stop member which, in its operative position, can be engaged by an abutment associated with the nozzle with which said stop means is associated, and further wherein the stop member is carried by a lever which can be locked in a position corresponding to the operative position of the stop member.

6. A machine for lasting side portions of shoes as recited in claim 5, wherein the abutment is carried by a piston rod of said piston-and-cylinder arrangement.

7. A machine for lasting side portions of shoes as recited in claim 6, wherein a toggle arrangement is provided for locking the lever as aforesaid.

8. A machine for lasting side portions of shoes as recited in claim 7, wherein fluid pressure operated means is provided for operating the toggle arrangement.

9. A machine for lasting side portions of shoes as recited in claim 8, wherein the adhesive applying means comprises two support arms on each of which a nozzle is supported, each arm being mounted for pivotal movement, independently of the other, about an axis extending heightwise of a shoe supported by the shoe support arrangement, thus to allow the nozzles to follow the edge contour of such shoe as aforesaid.

10. A machine for lasting side portions of shoes as recited in claim 9, wherein the lever is mounted for pivotal movement about the axis about which its associated support arm is mounted for movement as aforesaid.

11. A machine for lasting side portions of shoes as recited in claim 10, wherein each support arm is mounted on a carrier, the carriers being mounted for pivotal movement, independently of one another, about an axis extending widthwise of a shoe supported by the shoe support arrangement, to allow the nozzles to move heightwise of such shoe.

12. A machine for lasting side portions of shoes as recited in claim 11, wherein the toggle arrangement and the means for operating it are carried on the carrier carrying the support arm by which the nozzle associated with said arrangement is supported.

13. A machine for lasting side portions of shoes as recited in claim 12, wherein each piston-and-cylinder arrangement is carried on the carrier carrying the support arm by which the nozzle associated with said arrangement is supported.

* * * * *